US005161584A

United States Patent [19]

Krainaker et al.

[11] Patent Number: 5,161,584

[45] Date of Patent: Nov. 10, 1992

[54] WIRE STRAIGHTENER FOR ACCOMODATING DIFFERENT SIZE WIRES

[75] Inventors: Frank J. Krainaker, Trenton; Clyde A. Lawrence, Flemington, both of N.J.; Ivan Pawlenko, Holland; Larry P. Samson, Langhorne, both of Pa.

[73] Assignee: AT&T Bell Laboratories, Murray Hill, N.J.

[21] Appl. No.: 783,796

[22] Filed: Oct. 28, 1991

[51] Int. Cl.[5] ..... B21F 1/02

[52] U.S. Cl. ..... 140/147; 72/164

[58] Field of Search ..... 72/160, 164, 165; 140/147

[56] References Cited

U.S. PATENT DOCUMENTS

| | | | |
|---|---|---|---|
| 1,173,613 | 2/1916 | Smith | 72/165 |
| 3,343,574 | 9/1967 | Mersek | 72/164 |
| 4,977,934 | 12/1990 | Anderson et al. | 140/147 |

*Primary Examiner*—Lowell A. Larson
*Attorney, Agent, or Firm*—Robert B. Levy

[57] ABSTRACT

A wire straightener (10) for accommodating different size wires (12) includes first and second wire-bending stations (15*a*) and (15*b*) located on opposite sides of a central member (14). Each of the wire-bending stations (15*a*,15*b*) includes a pair of opposed, complementary contours (56,60), the individual length of which, and the spacing relative to the other contour, may be adjusted. Extending between the contours (56,60) along their respective lengths is a wire-receiving passage (62) which communicates with the wire-receiving passage in the other station. The opposed, complementary contours (56,60) of each wire-bending station are orthogonal to those of the other station so that as the wire is forced through the wire-receiving passage (62), the wire is bent in each of two orthogonal planes, causing it to be straightened upon exiting the second station.

7 Claims, 2 Drawing Sheets

WIRE STRAIGHTENER FOR ACCOMODATING DIFFERENT SIZE WIRES

TECHNICAL FIELD

This invention relates to a method and apparatus for straightening wires.

BACKGROUND OF THE INVENTION

When metallic wire is handled, there is a tendency for the wire to kink and bend. The presence of kinks and bends in a length of wire may impede its ability to be manipulated to effectuate termination of the wire, such as by attachment to a contact on a connector, or to a binding post. For this reason, wires are commonly straightened, with the aid of a wire straightener, prior to termination.

In the past, there existed roller-type straighteners which employ a plurality of rollers which press against the wire as it is drawn along the rollers to remove any kinks or bends. There also exist die-type straighteners which consist of a plurality of tubes, each having its ends beveled. The tubes are each mounted in a rotating arbor. Passage of the wire through each tube as the arbor rotates causes the wire to be straightened.

The roller-type and die-type straighteners tend to be large and bulky devices. For this reason, a third type of wire straightener, disclosed in U.S. Pat. No. 4,977,934 issued on Dec. 18, 1990 in the names of C. R. Anderson et al. and assigned to AT&T Bell Laboratories, has been developed. The Anderson et al. wire straightener is comprised of a plurality of tubes, each having at least a pair of bends, the bends oriented orthogonal to each other. A wire threaded through a tube will be bent in each of two perpendicular planes so that the wire will be straight upon emergence of the tube.

Each of the above-described wire straighteners incurs the disadvantage that each can only accept a wire of a particular diameter. This disadvantage may prove inconsequential if only a single wire size is present. However, in many instances, wires of different sizes must be straightened, necessitating multiple straighteners.

Thus, there is a need for a wire straightener for accommodating different size wires.

SUMMARY OF THE INVENTION

In accordance with the invention, a wire straightener for accommodating different size wires comprises a central member and a pair of adjustable, wirebending stations attached thereto opposite each other. Each wire-bending station serves to bend a wire threaded therethrough in a first plane oriented orthogonal to the other station so that as the wire passes through the stations, the wire is straightened thereby. In a preferred embodiment, each wire-bending station comprises a first and second pair of blocks, each block pair having a contour extending along both blocks so as to be opposite to, and complementary with, the contour extending along the blocks of the other pair. A wire-receiving channel extends between the opposed, complementary contours on the first and second pair of blocks for permitting a wire to be drawn between the two contours along the blocks. As a wire is passed through the wire-receiving passage of each station, the wire will be pulled across, and bent by, the complementary, opposed contours of the block pairs to remove kinks and bends. By adjusting the spacing between the blocks of each pair, and the spacing between the block pairs, the size of the wire-receiving passage of each wire-bending station, and the size of the wire capable of being accommodated thereby can be adjusted.

DETAILED DESCRIPTION

Figure 1:
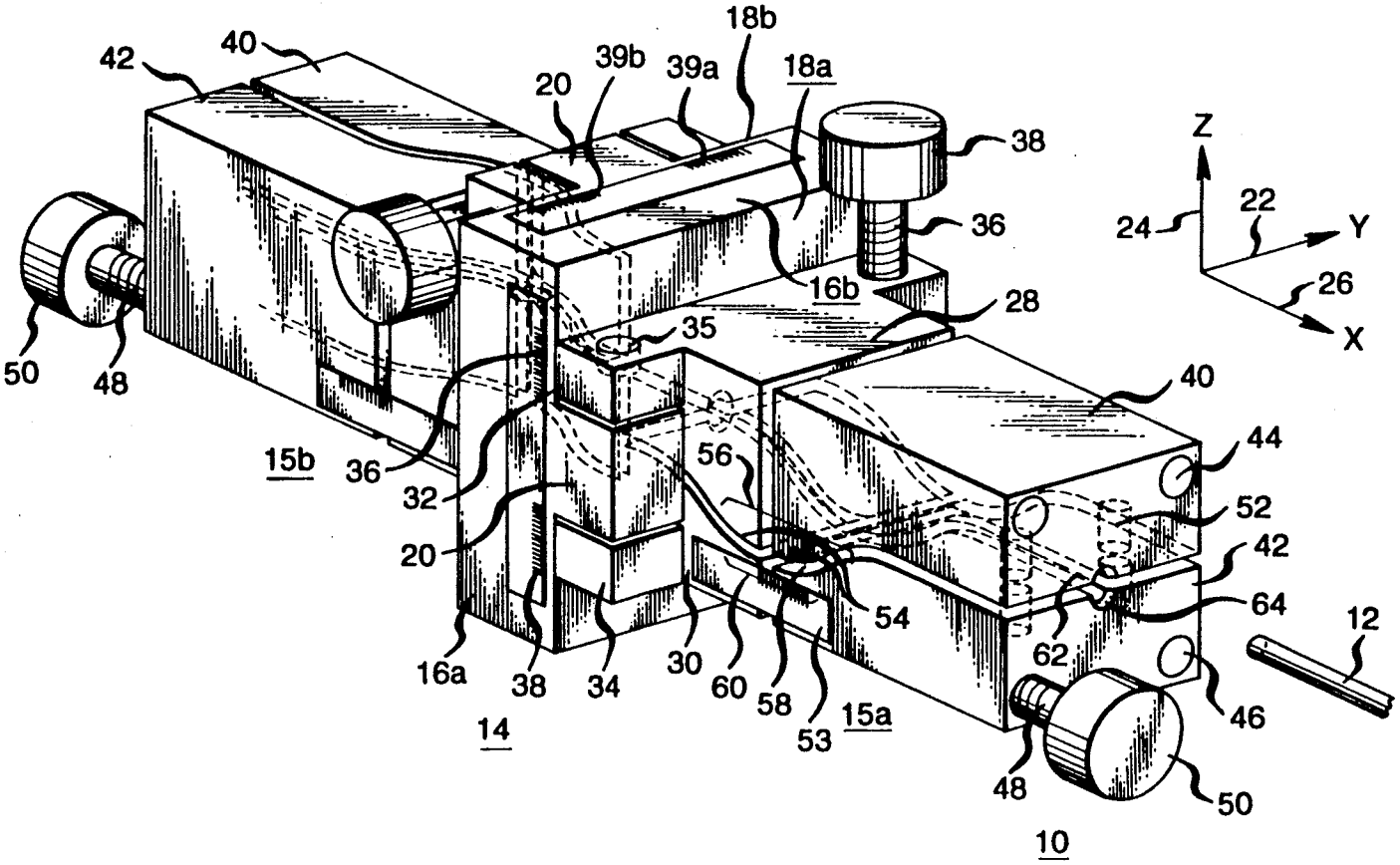
FIG. 1 is a first perspective view of a wire straightener in accordance with the invention.
Figure 2:
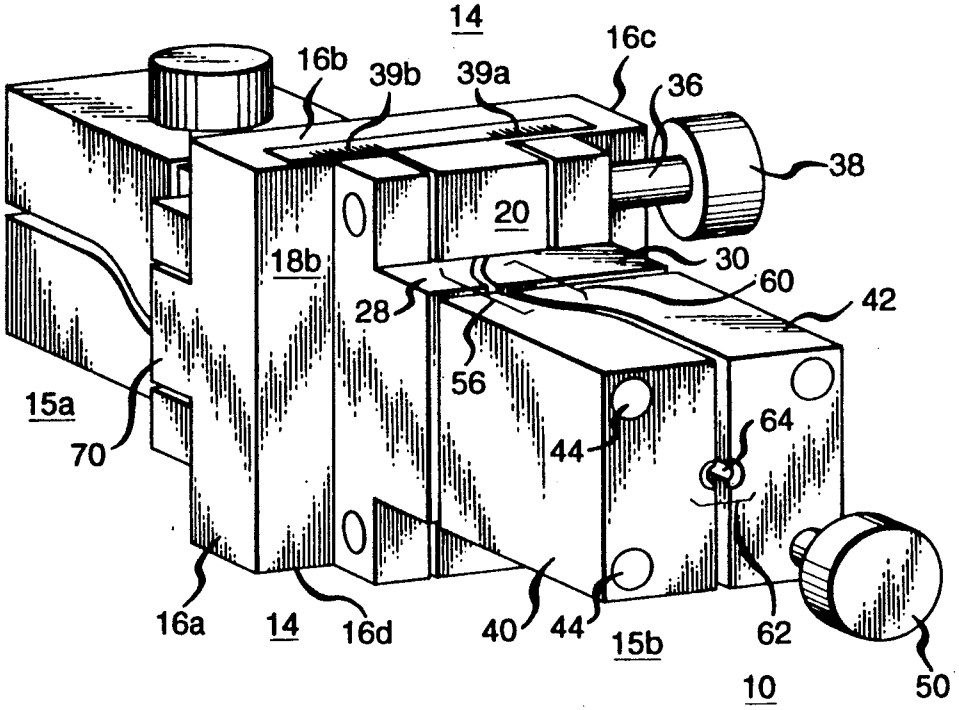
FIG. 2 is another perspective view of the wire straightener of FIG. 1 rotated 180°.

FIGS. 1 and 2 are perspective views (each rotated 180° from the other) of a wire straightener 10 in accordance with the invention for straightening separate wires 12 (only one shown) of different sizes (diameters). The straightener 10 comprises a central member 14 and two adjustable, wire-bending stations 15*a* and 15*b*, located on opposite sides of the central member so as to be in communication therethrough for bending the wire 12 in each of two planes oriented perpendicular to each other. In the illustrated embodiment, the central member 14 takes the form of a prism having four rectangular ends 16*a*–16*d*, best seen in FIG. 2, and two opposed rectangular faces 18*a* and 18*b*. (Instead of being rectangular, the ends 16*a*–16*d* and faces 18*a* and 18*b* of the member 14 could be square.)

As seen in FIGS. 1 and 2, the opposing faces 18*a* and 18*b* of the member 14 each have a rectangular lip 20 which projects therefrom and runs thereacross in a direction perpendicular to the lip on the other face for mounting a separate one of the adjustable wire-bending stations 15*a* and 15*b*. Referring to FIG. 1, the lip 20 on the right-hand face 18*a* of the member 14 extends horizontally along a first or y axis 22, while the lip on the left-hand face 18*b* of the member extends vertically along a second or z axis 24 perpendicular to the first axis. A third or x axis 26 lies perpendicular to each of the y and z axes 22 and 24.

The wire-bending station 15*a* includes a first pair of blocks 28 and 30, each having a rectangular prismatic extension 32, and 34, respectively, at its rearward (left-hand end) for abutting a separate one of the top and bottom surfaces of the lip 20 on the face 18*a* of the central member 14. A guide pin 35 and a threaded shaft 36 each extend vertically through the prismatic extension 32 of the block 30 to constrain the blocks from movement along the x and y axis 24 and 26, yet allow the blocks to move apart along the z axis 22. The threads on the shaft 35 threadedly engage the prismatic extensions 32 and 34 on the blocks 28 and 30, respectively, reverse from each other. Thus, when a knob 38 at the top of the threaded shaft is rotated in one direction the blocks 28 and 30 move closer together while rotating the knob in the opposite direction causes the blocks to move apart. Each of a pair of scales 39*a* and 39*b* is provided on the face 18*a* of the member 14 to indicate the relative separation of each of the blocks 28 and 30, respectively, from the lip 20 on the face 18*a*.

Each of the blocks 28 and 30 has a flat forward (right-hand) face (not shown) parallel with the face 18*a* for abutting a flat face on a separate one of a pair of blocks 40 and 42, respectively. A pair of guide pins 44 extends horizontally through the block 40 in spaced relationship and into the block 28 parallel to the x axis 24. The pins 44 constrain the block 40 from moving along the z and y axes 22 and 24, respectively, yet permit the block to move freely along the x axis. The block 42 is likewise constrained by a guide pin 46 and a threaded shaft 48 which extend horizontally therethrough in spaced relation and into the block 30 parallel to the x axis 26. The threads on the shaft 48 engage the blocks 42 and 30 reverse from each other so that when a knob 50, integral with the shaft, is rotated, the block 42 moves relative to the block 30. A pin 52 is pressed upwardly through the bottom of the block 42 at least partially into a slightly larger diameter slot (not shown) in the block 40 to enable these two blocks move in unison along the x axis 26 yet move apart from each other along the z axis 22. A scale 53 is provided across the blocks 30 and 42 to measure their separation from each other.

Each of the blocks 28 and 40 has a convex bottom surface portion 54 which is the mirror image of the convex bottom surface portion on the other block. In this way, when the blocks 28 and 40 abut each other, a relatively smooth convex contour 56 extends along the bottom of both blocks in the length direction (the x axis 26). Each of the blocks 30 and 42 has a concave top surface portion 58 directly opposite and complementary to the convex bottom surface portion 54 on a corresponding one of the overlying blocks 28 and 40, respectively. The concave surface portion 58 on the top of each of the blocks 30 and 40 is the mirror image of the concave surface portion on the top of the other block, thus forming a smooth contour 60 along the blocks when they abut each other.

Between the bottom surface of the block pair 28 and 40 and the top surface of the block pair 30 and 42 is a first wire-receiving passage 62 formed by opposed channels 64, either having square or rounded sides, and each running along the length of a separate one of the blocks of each pair parallel to the x axis 26. While the size of each of the half-cylindrical channels 64 is fixed, the size of the wire-receiving passage 62 may be effectively increased by increasing the z axis 22 separation between the block pairs 28 and 30 and 40 and 42, as well as the x axis 26 separation between the block pairs 28 and 40 and 30 and 42.

FIG. 2 is a perspective view of the wire-straightener 10 rotated 180° showing the details of the wire-bending station **15*b*. The wire-bending station 15*b* is configured identically to the wire-bending station 15*a* of FIG. 1, with the exception of being oriented orthogonal thereto. Thus, like the wire-bending station 15*a*, the wire-bending station 15*b* is comprised to two separate pairs of blocks 28 and 30, and 40 and 42 which have separate opposed, complementary contours 56 and 60, respectively. Since the wire-bending stations 15*a* and 15*b* are oriented orthogonal to each other, the opposed complementary contours 56 and 60 on the block pairs 28 and 40 and 30 and 42 of the latter wire-bending station will be orthogonal to the former. As with the wire-bending station 15*a*, a wire-receiving passage 62 extends between the opposed, complementary contours 56 and 60 on the block pairs 28 and 40 and 30 and 42, respectively, of the wire-bending station 15*b*. The wire-receiving passage 62 of the wire-bending station 15*b* communicates through the central member 14 with the passage in the wire-bending station 15*a*** so as to allow a wire to pass therebetween.

Operation of the wire guide 10 is commenced by first appropriately rotating the knobs 38 and 50 of each of the wire-bending stations **15*a* and 15*b* to adjust the spacing between the block pairs 28 and 40 and 30 and 42, as well as the spacing between the blocks of each pair. In this way, the wire-receiving passage 62 of each of the wire-bending stations 15*a* and 15*b* of FIGS. 1 and 2 can be adjusted to accommodate the size of the wire 12. The scales 36, 38 and 53 on each of the wire-bending stations 15*a* and 15*b*** enable the stations to be adjusted equally.

Once the wire-bending stations **15*a* and 15*b* are adjusted, then the wire 12 is forced into the wire-receiving passage 62 of one of the stations for passage therethrough and into the other station. (Whether the wire 12 is inserted into the wire-bending station 15*a* or 15*b* first is immaterial.) As the wire 12 is forced through the wire-receiving passage 62 of a first one of the two wire-bending stations 15*a* and 15*b*, the wire passes between the contour surfaces 56 and 60 of that station so as to be bent thereby in a first plane. Thereafter, the wire 12 enters the second of the two wire-bending stations 15*a* and 15*b* so as to pass between the contours 56 and 60 of that station which are oriented orthogonal to the contours of the other station. Upon exiting the second of the two wire-bending stations 15*a* and 15*b*, the wire 12 will have been bent by the orthogonally oriented contours 56 and 60** of the stations so as to now be relatively free of kinks and bends, It is to be understood that the above-described embodiments are merely illustrative of the principles of the invention. Various modifications and changes may be made thereto by those skilled in the art which will embody the principles of the invention and fall within the spirit and scope thereof.

We claim:

1. A method for straightening a wire comprising the steps of :

providing first and second opposed, complementary contours which have a first wire-receiving passage extending therebetween along their length;

adjusting the length of the first and second contours, and the spacing therebetween, to render the first wire-receiving passage capable of receiving a wire of a preselected size;

providing third and fourth opposed, complementary contours orthogonal to the first and second contours, respectively, the third and fourth contours having a second wire-receiving passage therebetween extending along their length, the second passage communicating with the first wire-receiving passage;

adjusting the length of the third and fourth contours and the spacing therebetween to render the second wire-receiving passage capable of receiving the wire of preselected diameter; and threading the wire through the first and second wire-receiving passages in succession so as to bend the wire along the first and second contours and the third and fourth contours, respectively, to straighten the wire.

2. The method according to claim 1 including the steps of:

indicating the relative length of, and spacing between, the first and second contours; and indicating the relative length of, and the spacing between, the third and fourth contours.

3. A wire straightener for accommodating different size wires comprising:

a central member having first and second opposed major surfaces;

a first wire-bending station attached to the first major surface of the central member, the first station including first and second opposed, complementary contours whose length and whose spacing from each other, is adjustable to permit passage of a wire of a preselected size between them along their length so as to be bent by the contours in a first plane; and a second wire-bending station attached to the second major surface of the central member, the second station including a pair of opposed, complementary third and fourth contours orthogonal to the first and second contours, the length of the third and fourth contours and the spacing between them being adjustable to permit the passage of the wire, after passage between the first and second contours, between the third and fourth contours along their length so as to be bent thereby in a second plane orthogonal to the first plane to straighten the wire.

4. The apparatus according to claim 3 wherein the first wire-bending station comprises:

first and second blocks slidably mounted to the first opposed surface of the central member for movement to and from each other along a first axis, the first and second blocks having opposed, complementary convex and concave surface portions thereon;

means for adjusting the spacing between the first and second blocks;

third and fourth blocks, each mounted to a separate one of the first and second blocks for movement thereto and therefrom along a second axis orthogonal to the first axis, each of the third and fourth blocks having opposed, complementary concave and convex surface portions, respectively, which are the mirror images of the convex and concave surface portions on the first and second blocks, respectively, so that the convex and concave surface portions on the first and third and second and fourth blocks, respectively, establish the first and second contours, respectively;

means for displacing the third and fourth blocks in unison from the first and second blocks; and first and second channels each running the length of the first and third, and second and fourth blocks, respectively, directly opposite the other channel to establish the first wire-receiving passage therebetween.

5. The apparatus according to claim 4 wherein the second wire-bending station comprises:

fifth and sixth blocks slidably mounted to the second opposed surface of the central member for movement to and from each other along a third axis perpendicular to the first and second axes, the fifth and sixth blocks having opposed, complementary convex and concave surface portions thereon orthogonal to the convex and concave surface portions on the first and secon blocks, respectively;

means for adjusting the spacing between the fifth and sixth blocks;

seventh and eighth blocks, each mounted to a separate one of the fifth and sixth blocks for movement thereto and therefrom along the second axis, each of the seventh and eighth blocks having opposed, complementary concave and convex surface portions, respectively, which are the mirror images of the convex and concave surface portions on the fifth and sixth blocks, respectively, so that the convex and concave surface portions on the fifth and seventh, and the sixth and eighth blocks, respectively, establish the third and fourth contours, respectively;

means for displacing the seventh and eighth blocks in unison from the fifth and sixth blocks, and third and fourth channels, each running the length of the fifth and seventh, and sixth and eighth blocks, respectively, directly opposite the other channel to establish the second wire-receiving passage therebetween.

6. The apparatus according to claim 4 further including:

first means for indicating the relative spacing of the first and second blocks from each other; and second means for indicating the relative spacing of the third and fourth blocks from the first and second blocks.

7. The apparatus according to claim 5 further including:

third means for indicating the relative spacing of the fifth and sixth blocks from each other; and fourth means for indicating the relative spacing of the seventh and eighth blocks from the fifth and sixth blocks.

* * * * *